US012714193B2

(12) United States Patent
Hirose

(10) Patent No.: US 12,714,193 B2
(45) Date of Patent: Aug. 25, 2026

(54) SHOE INSOLE

(71) Applicant: WINNING ONE CO., LTD., Tokyo (JP)

(72) Inventor: Hayato Hirose, Tokyo (JP)

(73) Assignee: WINNING ONE CO., LTD., Tokyo (JP)

( * ) Notice: Subject to any disclaimer, the term of this patent is extended or adjusted under 35 U.S.C. 154(b) by 567 days.

(21) Appl. No.: 17/620,686

(22) PCT Filed: Oct. 29, 2020

(86) PCT No.: PCT/JP2020/040727
§ 371 (c)(1),
(2) Date: Dec. 18, 2021

(87) PCT Pub. No.: WO2021/085574
PCT Pub. Date: May 6, 2021

(65) Prior Publication Data

US 2022/0264995 A1 Aug. 25, 2022

(30) Foreign Application Priority Data

Oct. 30, 2019 (JP) ..... 2019197982

(51) Int. Cl.
*A43B 17/00* (2006.01)
*A43B 7/142* (2022.01)
(Continued)

(52) U.S. Cl.
CPC ..... *A43B 17/006* (2013.01); *A43B 7/142* (2013.01); *A43B 7/143* (2013.01); *A43B 17/14* (2013.01)

(58) Field of Classification Search
CPC ..... A43B 7/144; A43B 7/1485; A43B 17/006; A43B 7/142; A43B 7/143; A43B 7/1445;
(Continued)

(56) References Cited

U.S. PATENT DOCUMENTS 4,079,526 A * 3/1978 Fukuoka ..... A43B 7/14 36/11.5
4,586,273 A * 5/1986 Chapnick ..... A43B 17/02 36/154
(Continued)

FOREIGN PATENT DOCUMENTS

EP 0173396 A2 3/1986
JP S61-168301 A 7/1986
(Continued)

OTHER PUBLICATIONS

International Search Report for International Application No. PCT/JP2020/040727.
(Continued)

*Primary Examiner* — Grady Alexander Nunnery
(74) *Attorney, Agent, or Firm* — JCIP; Joseph G. Chu

(57) ABSTRACT

A sheet section and a support plate formed from a material harder than the sheet section, each including an inner wall section and an outer wall section, curved in an arch shape and a central wall section, formed between the inner wall section and the outer wall section. The support plate includes an inner ridge section, formed on the boundary between the inner and the central wall sections, and an outer ridge section, formed on the boundary between the outer wall and central wall sections. A plurality of through-holes, arranged in the longitudinal direction of the support plate, are formed in the inner wall section and the outer wall section of the support plate. An upper surface of the central wall section located between the inner ridge section and the outer ridge section is curved so as to draw an arch in the longitudinal direction of the support plate.

20 Claims, 7 Drawing Sheets

(51) Int. Cl.
*A43B 7/143* (2022.01)
*A43B 17/14* (2006.01)

(58) Field of Classification Search
CPC ..... A43B 7/148; A43B 13/386; A43B 17/02; A43B 17/08
See application file for complete search history.

(56) References Cited

U.S. PATENT DOCUMENTS

| | | | | |
|---|---|---|---|---|
| 5,184,409 | A * | 2/1993 | Brown | A43B 7/144 36/173 |
| 5,282,326 | A * | 2/1994 | Schroer, Jr. | A43B 17/023 36/145 |
| 5,625,965 | A * | 5/1997 | Blissett | A43B 13/38 36/43 |
| 2004/0181971 | A1* | 9/2004 | Turkbas | A61F 5/14 36/88 |
| 2007/0028484 | A1* | 2/2007 | Akhidime | A43B 13/181 36/76 R |
| 2008/0072461 | A1* | 3/2008 | Howlett | A43B 13/38 36/145 |
| 2010/0218399 | A1* | 9/2010 | Jeong | A43B 7/144 36/44 |
| 2011/0275731 | A1* | 11/2011 | Shimizu | C08J 9/10 521/139 |
| 2013/0074371 | A1* | 3/2013 | Borel | A43B 7/142 36/102 |
| 2014/0245631 | A1* | 9/2014 | Joseph | A43B 7/141 12/142 N |
| 2015/0121722 | A1 | 5/2015 | Hirose | |

FOREIGN PATENT DOCUMENTS

| | | | |
|---|---|---|---|
| JP | H07-079805 | A | 3/1995 |
| JP | 2005160727 | A | 6/2005 |
| JP | 3979765 | B2 | 9/2007 |
| JP | 2010125100 | A | 6/2010 |
| JP | 3167048 | U | 3/2011 |
| JP | 2011056296 | A | 3/2011 |
| JP | 2015085134 | A | 5/2015 |
| KR | 10-1075172 | B1 | 10/2011 |
| KR | 10-2014-0104207 | A | 8/2014 |

OTHER PUBLICATIONS

Notice of Reasons for Refusal for Japanese Patent Application No. 2021-517496.
Written Opinion of International Searching Authority for International Application No. PCT/JP2020/040727.
Notice of Opinion Submission dated Jun. 23, 2023 from the Korean Patent Office for Korean Application No. 10-2021-7041178.
Notice of Reasons for Refusal having a mailing date of Sep. 28, 2021 for Japanese Application No. 2021-517496.
Extended European Search Report Dated Jan. 9, 2023 for European Application No. 20883547.0.
Examination Report No. 1 dated Feb. 9, 2023 for Australian Application No. 2020376694.
Office Action dated Jan. 13, 2023 for Canadian Application No. 3144203.

* cited by examiner (a)

(b)

SHOE INSOLE

TECHNICAL FIELD

The present invention relates to a shoe insole.

BACKGROUND ART

During exercise, a person may experience pain and distortion in their body due to the burden on the body, especially the joints of the foot and in turn the legs and back. In consideration of such pain and distortion, the inventor of the present application has been developing, as an invention similar to that of the present application, a shoe insole with which the balance of the skeletal structure of the foot can be regulated when the shoe is worn (for example, see Patent Document 1 below).

In the shoe insole disclosed in Patent Document 1, a center convex section and a center concave section on both sides of the center convex section are provided on an upper surface side of a sheet section, on which approximately the entire sole of the foot is placed, so as to oppose a center portion of the sole of the foot slightly more toward the heel than the ball of the foot. Further, the shoe insole disclosed in Patent Document 1 comprises a hard support plate which is attached so that an area from approximately the center to a portion corresponding to the heel on the bottom surface side of the sheet section can be substantially covered. In the support plate, two rows of through-holes into which portions of the sheet section are fitted are formed approximately along the edges on both sides of the support plate. Further, in the support plate, a ridge section extending in the longitudinal direction of the insole is formed on the inside of the two rows of through-holes.

Due to the above configuration, the insole of Patent Document 1 achieves an extremely superior effect in which the skeletal structure of the foot can be arranged at a preferred position, and the burden caused by distortion on the foot and body when the user is exercising, such as walking and the like, can be reduced.

PRIOR ART DOCUMENTS

Patent Documents

Patent Document 1: JP2015-085134A

SUMMARY OF INVENTION

Technical Problem

The feet are particularly constituted by a combination of many bones, and the feet support the weight of the entire body, and thus a person's posture can become unbalanced with even just a slight deviation of the foot joints. Further, deviations of the foot joints can also cause daily burdens on completely different areas besides the feet because the foot joints also attempt to compensate for loss of balance in joints above the feet as well, and this can lead to bodily injuries. Therefore, there is a need to naturally maintain appropriate meshing of the joints at a higher level without needlessly restricting the movement of the foot.

Thus, the inventor has developed a shoe insole with which appropriate meshing of the joints can be naturally maintained at a higher level without needlessly restricting the movement of the foot.

Solution to Problem

A shoe insole of the present invention comprises: a sheet section disposed on the entire base of a shoe, the sheet section including a toe section formed such that the toes of the foot can be disposed therein, a bulged section formed such that the tips of the metatarsal bones at which the width of the foot protrudes farthest to the left and right can be disposed therein, an arch section formed such that a section of the foot from the metatarsal bones to directly below the lateral malleolus can be disposed therein, and a heel section formed such that a section of the foot from directly below the lateral malleolus to the heel bone rearward of the lateral malleolus can be disposed; and a support plate that is adhered to a bottom surface of the arch section and the heel section of the sheet section, and that is formed from a material which is harder than the sheet section. As will be discussed in more detail below, a sheet section 2 and a support plate 3 each respectively comprise in the arch sections 6, 6': inner wall sections 8, 8' curved in an arch shape with end sections 8*e*, 8*e'* standing upward such that at least a first metatarsal bone is disposed therein; outer wall sections 9, 9' curved in an arch shape with end sections 9*e*, 9*e'* standing upward such that at least a fifth metatarsal bone is disposed therein; and a central wall section formed between the inner wall section and the outer wall section. The support plate comprises an inner ridge section formed on a boundary between the inner wall section and the central wall section, and an outer ridge section formed on approximately a boundary between the outer wall section and the central wall section. A plurality of through-holes, arranged in the longitudinal direction of the support plate, are formed in the inner wall section and the outer wall section of the support plate. At least an upper surface UP of the central wall section located between the inner ridge section and the outer ridge section is curved so as to draw an arch in the longitudinal direction of the support plate.

According to the above configuration, the arch shape of a central rear wall section of the sheet section is supported by the upper surface UP shape of a central rear wall section of the support plate, and thus an arch shape is properly formed in the foot when the foot is placed on the upper surface UP of the sheet section.

The sheet section and the support plate of the shoe insole of the present invention may include an extension section that protrudes upward so as to oppose, from a side surface, the heel section located directly below the lateral malleolus and/or a base end section of the arch section.

According to the above configuration, the heel section located directly below the lateral malleolus and/or the base end section of the arch section, i.e. the lower portion of the cuboid bone, is supported from the outside, and thus collapse of the skeletal structure of the foot can be prevented.

The support plate of the shoe insole of the present invention may be formed with a degree of hardness of from 40D to less than 72D, and may be arranged along a bottom surface shape of the sheet section with a fixed thickness.

According to the above configuration, the burden on the foot caused by the support plate can be reduced.

The support plate of the shoe insole of the present invention may be formed with a degree of hardness of from 40D to less than 65D, and may be arranged along a bottom surface shape of the sheet section with a fixed thickness.

According to the above configuration, the burden on the foot caused by the support plate can be further reduced.

In a heel section of the support plate of the shoe insole of the present invention, an opening into which a portion of the sheet section is fitted may be formed.

According to the above configuration, the body weight, which tends to be put on the heel section due to a longitudinal arch shape which is formed in the foot by an arch shape formed by the central rear wall section of the sheet section and the support plate, can be appropriately received at the heel section, and the balance of the body weight on the feet becomes easier to maintain.

The sheet section of the shoe insole of the present invention preferably comprises at least two foamed resin layers having different degrees of hardness and impact resilience coefficients, wherein a first layer on an upper surface side and a second layer provided below the first layer constitute impact resilient resin layers comprising, as a main component, an ethylene-vinyl acetate copolymer.

Further, the measured degrees of hardness as measured using an Asker rubber durometer C-type and the impact resilience coefficients as measured according to ISO4662 of the first layer and the second layer preferably satisfy the following relationships.

Measured Degree of Hardness: the first layer<the second layer

Impact Resilience Coefficient: the first layer<the second layer

More specifically, the measured degree of hardness as measured using an Asker rubber durometer C-type of the second layer is preferably 50 to 60, and the impact resilience coefficient as measured according to ISO4662 of the second layer is preferably 55% to 65%. Further, the measured degree of hardness as measured using an Asker rubber durometer C-type of the first layer is preferably 23 to 28, and the impact resilience coefficient as measured according to ISO4662 of the first layer is preferably 47% to 53%.

Effects of Invention

The present invention achieves an effect of enabling the appropriate meshing of the joints to be naturally maintained at a higher level without needlessly restricting the movement of the foot.

DESCRIPTION OF EMBODIMENTS

Figure 1:
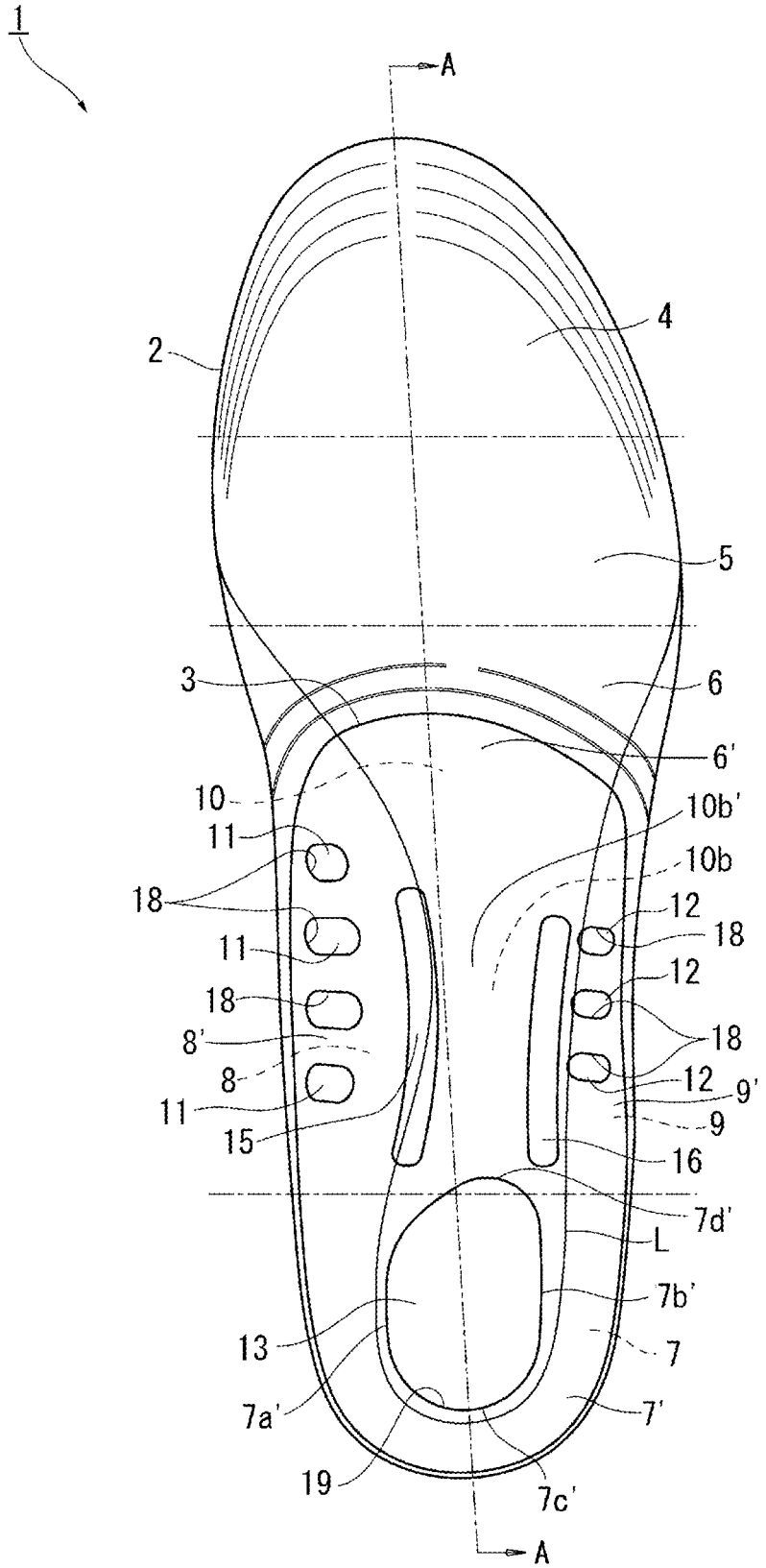
FIG. 1 is a bottom surface view illustrating a shoe insole according to one embodiment of the present invention.

In the following, embodiments of the shoe insole of the present invention shall be explained while referring to the drawings. The dimensions of each portion in the drawings used in the following explanations are not limited to being identical to the actual dimensions, and can be appropriately modified.

Figure 2:
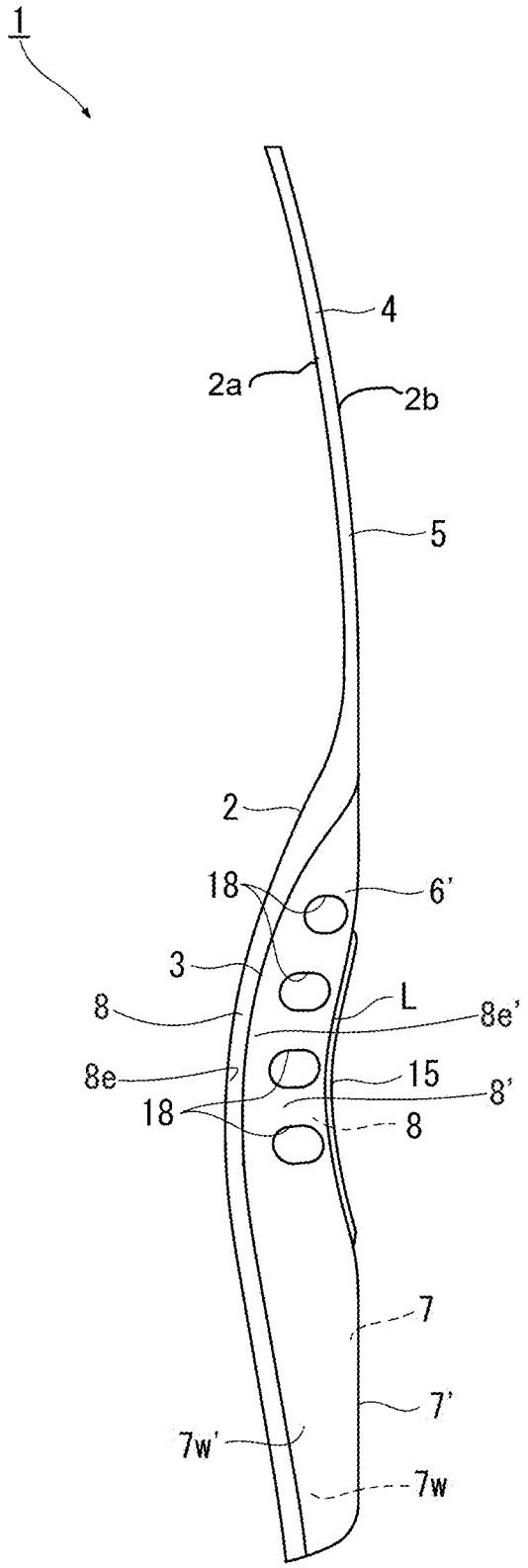
FIG. 2 is a right-side surface view illustrating the shoe insole according to one embodiment of the present invention.

As shown in FIGS. 1 and 2, a shoe insole 1 according to one embodiment of the present invention includes the sheet section 2 disposed on the entire base of a shoe (not illustrated), and the support plate 3 that covers the sheet section 2 from below over an area from a central portion to a heel portion in the longitudinal direction of the sheet section 2.

The sheet section 2 includes, from the distal end to the rear end, a toe section 4, a bulged section 5 at which the left-right width is most bulged, an arch section 6, and a heel section 7.

The toe section 4 is a portion which is formed such that the toes of the foot are disposed therein.

Figure 3A:
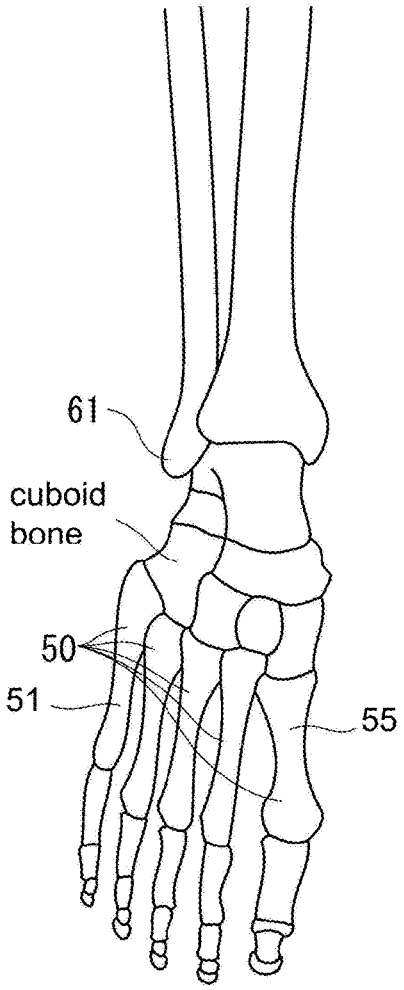
FIG. 3(*a*) is a schematic view illustrating the skeletal structure of the right foot when viewed from the front surface, and FIG. 3(*b*) is a schematic view illustrating the skeletal structure of the right foot when viewed from the outside (little toe side).
Figure 3B:
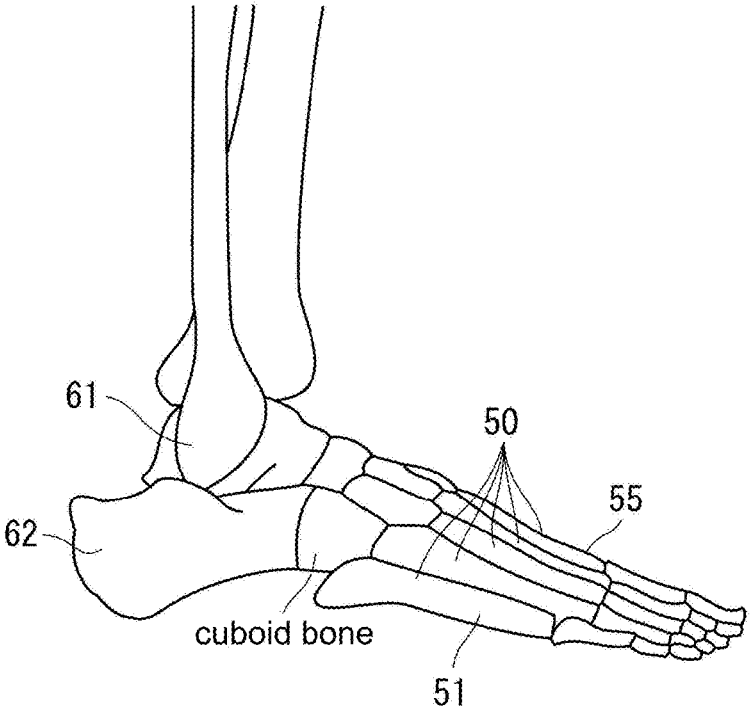

The bulged section 5 is a portion which is formed such that the tips of the metatarsal bones 50 as shown in FIG. 3 (i.e. from the thenar eminence to the hypothenar eminence), at which the width of the foot protrudes farthest to the left and right, are disposed therein.

The heel section 7 is a portion which is formed such that a section of the foot directly below the lateral malleolus 61 to the heel bone 62 rearward of the lateral malleolus 61 as illustrated in FIG. 3 is disposed therein.

The arch section 6 is a portion which is formed such that a section of the foot from the metatarsal bones 50 (excluding the bulged section 5) to directly below the lateral malleolus 61 as illustrated in FIG. 3 is disposed therein.

The outer shape of the sheet section 2 is formed so as to follow the approximate outer shape of the overall foot in a plan view.

The arch section 6 of the sheet section 2 includes: an inner wall section 8 formed such that mainly a first metatarsal bone 51 shown in FIG. 3 is disposed therein; an outer wall section 9 formed such that mainly a fifth metatarsal bone 55 shown in FIG. 3 is disposed therein; and a central wall section 10 formed between the inner wall section 8 and the outer wall section 9.

In more detail, the inner wall section 8 is a portion that is formed to be curved in an arch shape which protrudes upward with the end section 8*e* standing smoothly upward such that mainly the first metatarsal bone 51 shown in FIG. 3 is disposed therein. A plurality of protrusions 11 are formed spaced apart by intervals in the longitudinal direction on the bottom surface side of the inner wall section 8.

The outer wall section 9 is a portion that is formed to be curved in an arch shape which protrudes upward with the end section standing 9*e* upward such that mainly the fifth metatarsal bone 55 shown in FIG. 3 is disposed therein. A plurality of protrusions 12 are formed spaced apart by intervals in the longitudinal direction on the bottom surface side of the outer wall section 9.

Figure 4:
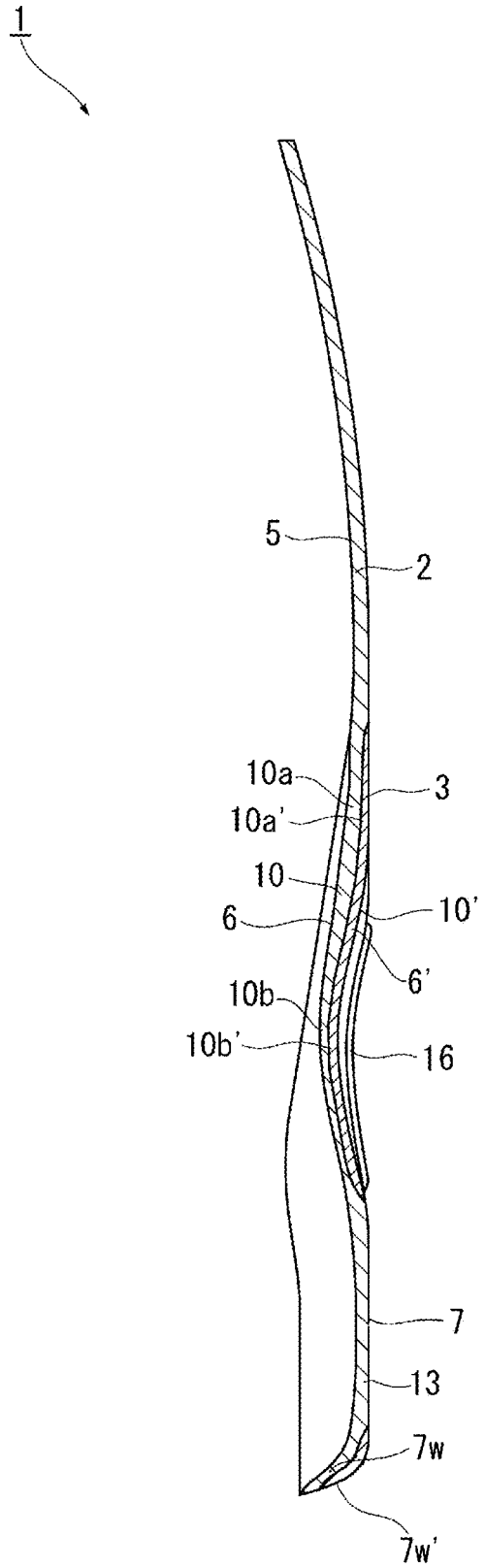
FIG. 4 is a cross-section view along the arrowed line A-A shown in FIG. 1.

As shown in FIG. 4, the central wall section 10 has, in the cross-section view along A-A of FIG. 1, a central front wall section 10*a* in which both the upper and bottom surfaces are inclined upward in an approximately linear shape toward the toe section 4, and a central rear wall section 10*b* in which both the upper and bottom surfaces are curved so as to draw an arch shape in the front-rear direction.

The central rear wall section 10*b* is formed with an approximately fixed thickness, and the central front wall section 10*a* is formed to be slightly thicker than the central rear wall section 10*b*.

As shown in FIGS. 2 and 4, the heel section 7 of the sheet section 2 has, on an end section thereof, a standing up section 7*w* so that a lower end portion of the heel of the foot can be surrounded and held from a side surface side. The inner wall section 8, the standing up section 7*w*, and the outer wall section 9 are smoothly continuous.

As shown in FIGS. 1 and 4, a thick section 13 which absorbs the body weight applied to the heel section 7 is formed on a bottom surface side of the heel section 7 of the sheet section 2.

Figure 5:
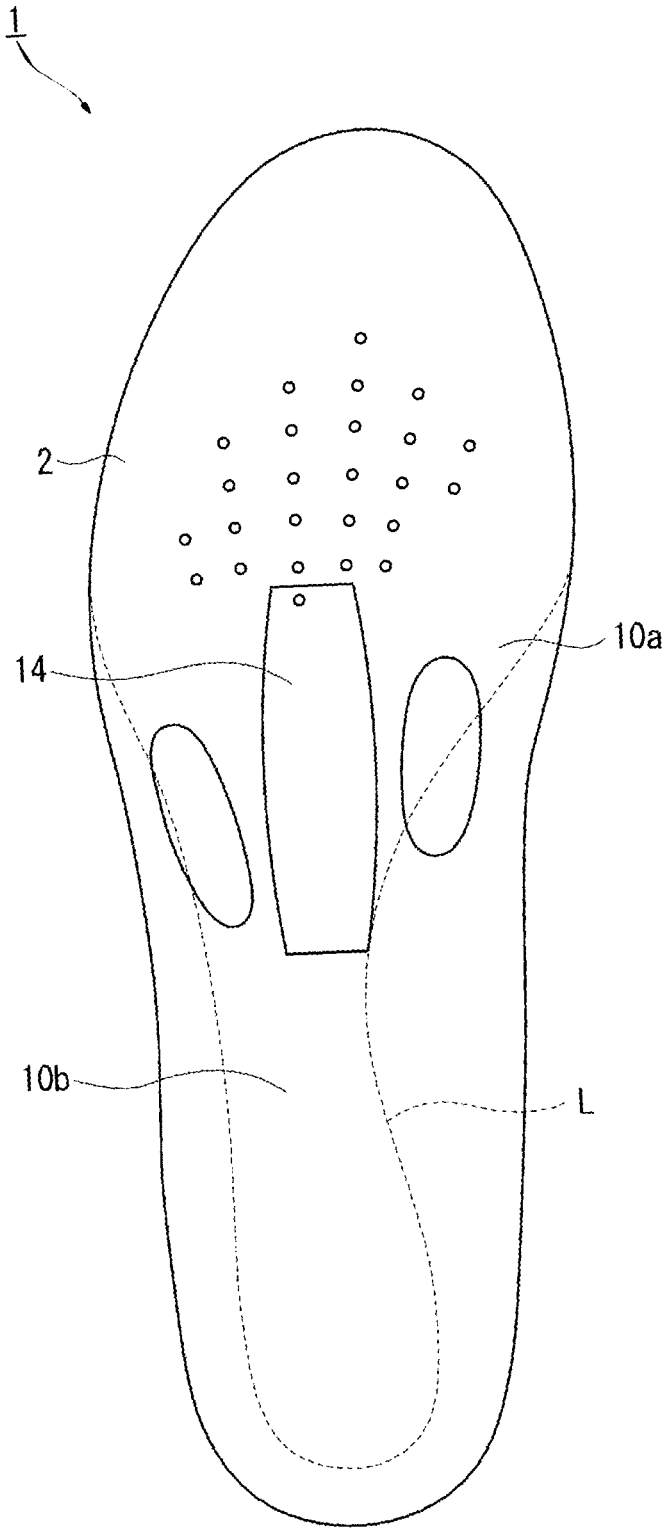
FIG. 5 is an upper surface view illustrating the shoe insole according to one embodiment of the present invention.

As shown in FIG. 5, a central convex section 14 which is raised and extends in the front-rear direction is formed on the upper surface UP of the sheet section 2 approximately in the center in the width direction of the central front wall section 10*a*. The central convex section 14 is formed so as to be able to fit into a recess of the inner foot immediately to the rear of the thenar eminence that supports the body weight when standing on so-called tiptoe. The left and right sides of the central convex section 14 are relatively slightly recessed.

The sheet section 2 is molded from rubber or a synthetic resin, etc., and is preferably formed a soft synthetic resin such as ethylene-vinyl acetate copolymer (EVA). The sheet section 2 should be formed to have a degree of hardness in the range of 22 to 80 as measured using an Asker rubber durometer (C-type).

Figure 6A:
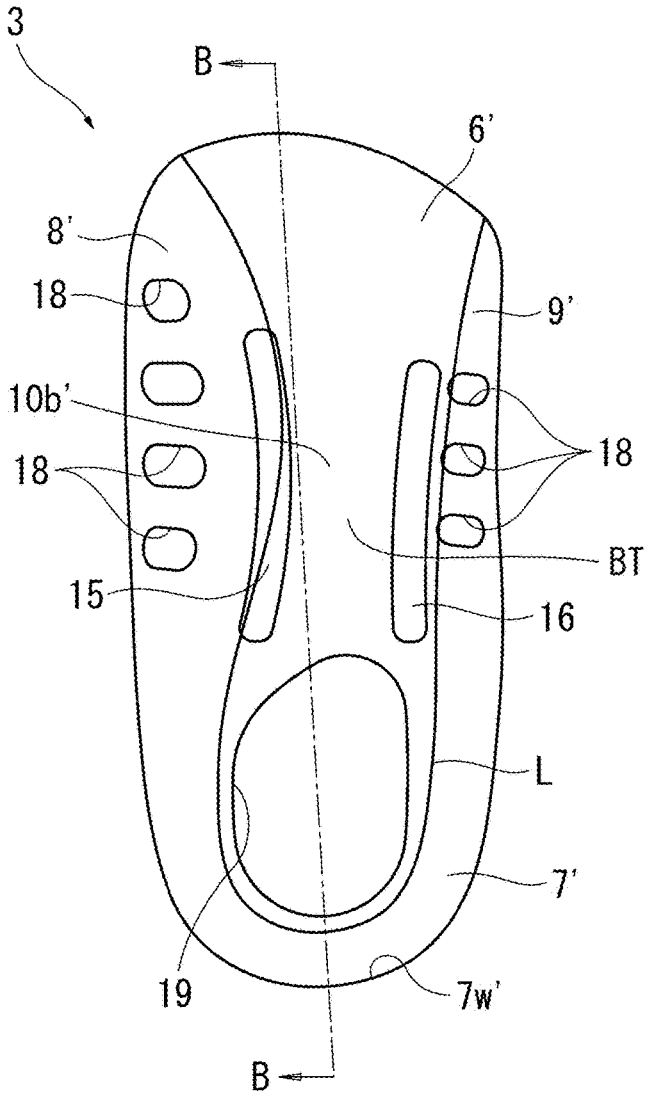
FIG. 6(*a*) is a bottom surface view illustrating a support plate of the shoe insole according to one embodiment of the present invention, and FIG. 6(*b*) is a cross-section view along the arrowed line B-B.
Figure 6B:
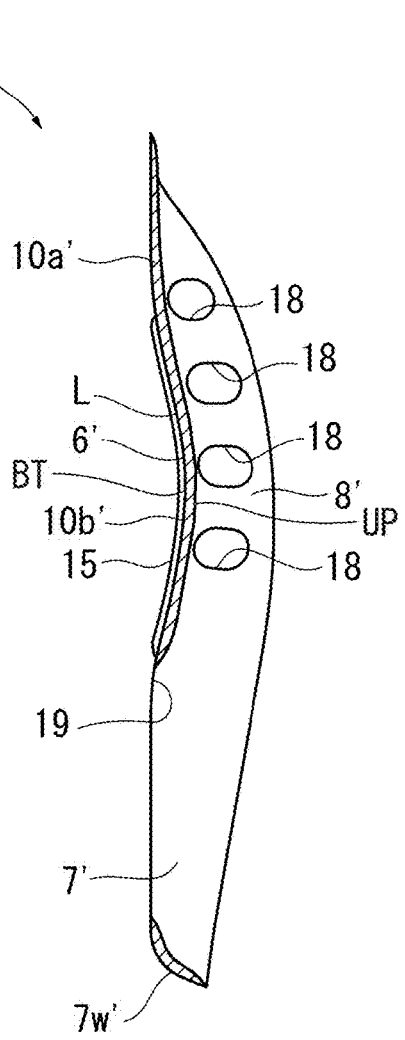

As shown in FIG. 1, 4, or 6, the support plate 3 closely adheres along the shape of the sheet section 2 so as to cover from the arch section 6 to the heel section 7.

Specifically, the support plate 3 includes the following sections which correspond to the sections of the sheet section 2: an arch section 6'; an inner wall section 8', an outer wall section 9', a central front wall section 10*a*', and a central rear wall section 10*b*' that constitute the arch section 6'; and a heel section 7'. The heel section 7' of the support plate 3 also has a standing up section 7*w*' that surrounds and holds the side surfaces of the heel of the foot.

The support plate 3 has an inner ridge section 15 and an outer ridge section 16 formed respectively on approximately the boundary between the inner wall section 8' and the central rear wall section 10*b*' and on approximately the boundary between the outer wall section 9' and the central rear wall section 10*b*', i.e. approximately on or along a line L.

Figure 7:
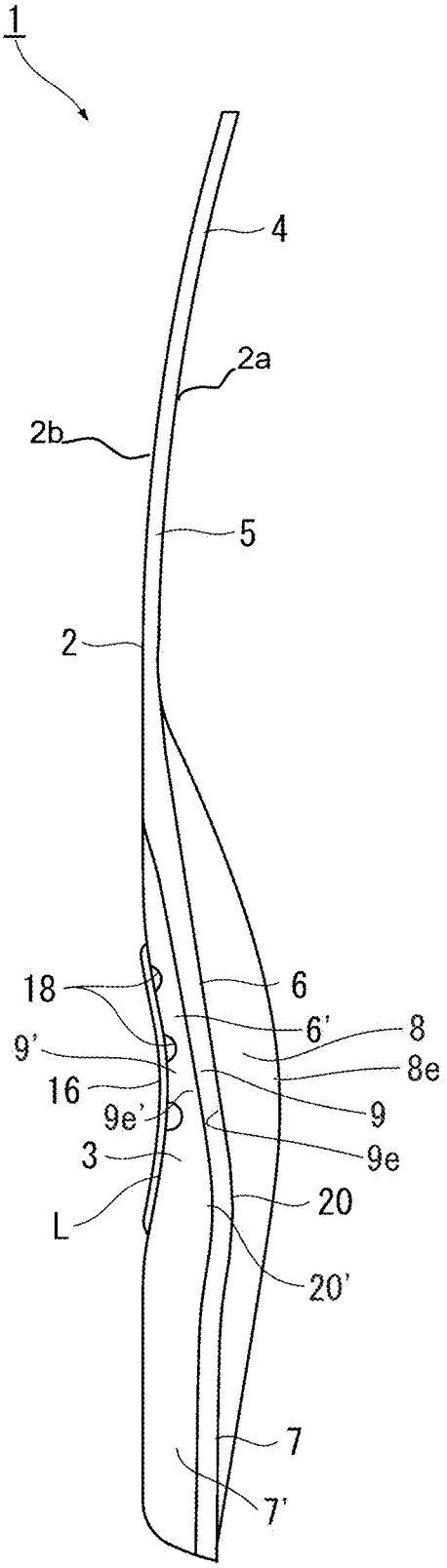
FIG. 7 is a left-side surface view illustrating the shoe insole according to one embodiment of the present invention.

As shown in FIG. 2, the inner ridge section 15 is formed in an arch shape approximately parallel to the arch shape appearing at the lower end when viewing the inner wall section 8' from the side surface. Further, as shown in FIG. 7, the outer ridge section 16 is formed in an arch shape approximately parallel to the arch shape appearing at the lower end when viewing the outer wall section 9' from the side surface.

The inner ridge section 15 and the outer ridge section 16 are both formed in a band shape with an approximately fixed width dimension.

The inner ridge section 15 comprises an inner ridge. The outer ridge section 16 comprises an outer ridge. As shown in FIG. 1 and FIG. 6(*a*), an entirety of the inner ridge is entirely spaced apart from an entirety of the outer ridge such that the inner ridge and the outer ridge are not directly connected to each other.

The central front wall section 10*a*' of the support plate 3 is formed in the same shape as the sheet section 2, i.e. an approximately flat shape. The central rear wall section 10*b*' of the support plate 3 has an approximately fixed thickness overall, and the upper surface UP and bottom surface BT thereof form a longitudinal direction arch shape nearly identical to the bottom surface of the central rear wall section 10*b* of the sheet section 2 and the inner ridge section 15 and the outer ridge section 16.

As shown in FIG. 1, in the standing up section of the inner wall section 8', a plurality of through-holes 18 are formed spaced apart along the longitudinal direction of the support plate 3. The through-holes 18 formed in the inner wall section 8' of the support plate 3 are formed so that the protrusions 11 formed on the bottom surface BT side of the inner wall section 8 of the sheet section 2 can fit therein without any gaps. The bottom surface BT of the support plate 3 and the top surface of the protrusions 11 are formed so as to be flush with each other.

In the outer wall section 9', a plurality of the through-holes 18 are formed spaced apart along the longitudinal direction of the support plate 3. The through-holes 18 formed in the outer wall section 9' of the support plate 3 are formed so that the protrusions 12 formed on the bottom surface side of the outer wall section 9 of the sheet section 2 can fit therein without any gaps. The bottom surface BT of the support plate 3 and the top surface of the protrusions 12 are formed so as to be flush with each other.

In this way, the support plate 3 is formed to match the shape of each section of the sheet section 2, and thereby, as shown in FIGS. 1 and 5, the inside of the line L serving as the boundary generally contacts a horizontal plane such as the surface of the ground except for the central rear wall section 10*b*', and the outside of the line L is formed so as to stand up smoothly with the line L as a boundary. Further, the arch section 6 is firmly raised up by the central rear wall section 10*b*' and the inner ridge section 15 and the outer ridge section 16 which are formed approximately on the line L, and thus the longitudinal arch of the foot can be supported.

In the heel section 7' of the support plate 3, an opening 19 which absorbs and receives a load applied from the heel is formed.

The opening 19 is formed approximately parallel to the line L on an inner side 7*a*' and an outer side 7*b*' of the heel section 7', and extends slightly inward so as to separate from the line L on a rear side 7*c*' of the heel section 7'. Further, on the outside of a distal end side 7*d*', the opening 19 expands approaching the central rear wall section 10*b*', which gradually warps up diagonally.

Due to this configuration, it can be anticipated that a load which extends between the heel of the foot and the outside in the width direction of the arch of the foot and which may be applied to the outer tendons and the like, onto which the body weight is prone to be strongly loaded, can be reduced, and the body weight which is applied approximately vertically downward from the lateral malleolus 61 can be softly received.

In particular, if the thickness of the sheet section 2 is formed to be thin within an allowable range so as to attempt to form the shoe insole 1 to be slim, the support plate 3 fits closer to the sole of the foot, and thus the portions at which the body weight is prone to be loaded, such as the heel and tendons, etc. of the foot, more readily receive the load caused by the hardness of the support plate 3. However, by forming the opening 19 with the shape described above, it can be anticipated that the load on the heels and tendons, on which a large body weight is prone to be loaded, can be effectively reduced, and the fit of the sheet section 2 and the support plate 3 can be highly maintained.

As shown in FIG. 4, the thickness of the support plate 3 is formed to be a fixed thickness, excluding the edges which surround the central front wall section 10*a*, the through-holes 18, and the opening 19 as well as the edge that serves as the outer peripheral edge of the support plate 3. Specifically, the thickness of the support plate 3 is formed to be 1.1 mm to less than 2.1 mm, preferably about 2 mm.

The central front wall section 10*a*' of the support plate 3 is formed to be about 10% thinner than the central rear wall section 10*b*' and the heel section 7', etc. Specifically, the central front wall section 10*a*' is formed with a thickness of 1.0 mm to less than 1.9 mm.

The outer peripheral edge of the support plate 3 and the edges that form the through-holes 18 and the opening 19 are chamfered so as to fit easily to the sheet section 2.

The inner ridge section 15 and the outer ridge section 16 of the support plate 3 protrude by 0.9 mm to less than 1.1 mm, preferably 1.0 mm, from the top surface (namely, bottom surface BT) of the central rear wall section 10*b*' which surrounds them. The inner ridge section 15 and the outer ridge section 16 are both formed to be solid.

The support plate 3 is formed by a hard resin such as a thermoplastic polyurethane (TPU). The support plate 3 is formed with a degree of hardness of from 40D to less than 72D, or from 45D to less than 65D, as measured using an Asker rubber durometer (D-type).

The entirety of the upper surface of the support plate 3 is closely fitted to the bottom surface BT of the sheet section 2 by compression bonding so that there are no gaps therebetween and the support plate 3 cannot be easily separated from the sheet section 2. The protrusions 11 and 12 and the thick section 13 formed on the sheet section 2 are fitted into the corresponding through-holes 18 and the opening 19 of the support plate 3, and thus are approximately flush with the top surface of the support plate 3.

The shoe insole 1 of the present invention having the configuration described above achieves the following effects.

The elastic force of the longitudinal arch of the shoe insole 1 is further increased due to the longitudinal arch shapes having approximately the same curvature of the sheet section 2, the lower end of the inner wall section 8' and the lower end of the outer wall section 9' of the support plate 3, the inner ridge section 15, the outer ridge section 16, and the upper and bottom surfaces UP, BT of the central rear wall section 10*b*'. Further, due to the arch shapes of the inner ridge section 15, the outer ridge section 16, and the central rear wall section 10*b*', the central portion in the width direction of the arch of the foot (between the inner longitudinal arch and the outer longitudinal arch) can be flexibly and reliably held in a longitudinal arch shape.

A longitudinal arch shape is firmly formed in the upper and bottom surfaces UP, BT of the central rear wall section 10*b* of the sheet section 2, and the inner ridge section 15, the outer ridge section 16, and the upper surface UP of the central rear wall section 10*b*' of the support plate 3 securely retain this longitudinal arch shape. Therefore, any unevenness in the body weight of the thenar eminence and the hypothenar eminence placed on the bulged section 5 and the body weight of the heel placed on the heel section 7 can be prevented. Accordingly, the center of gravity can be guided to the correct position by the shape of the shoe insole 1.

In addition, the bones and joints of the foot can be appropriately held without forming any unnecessary gaps on the sole of the foot by the aforesaid sections as well as the central convex section 14 formed on the central front wall section 10*a* of the sheet section 2.

The first metatarsal bone 51 and the fifth metatarsal bone 55 shown in FIG. 3 as well as the lower side surface of the heel can be firmly, but without becoming cramped, held by the inner wall section 8', the outer wall section 9', and the standing up section 7*w*' of the heel section 7'.

By reciprocally combining the above-described effects, the bones of the foot which are connected by a plurality of joints can be prevented from deviating or distorting, and can be easily retained in an appropriately assembled state. Thus, an effect is achieved in which distortions in the posture based on a deviation in the bones of the foot can be prevented during exercise such as walking.

Meanwhile, there was a problem with the support plate 3 of the shoe insole 1 of the present invention in that slight pain developed in the foot after use over a long period of time even when the support plate 3 was within the range of hardness of a TPU resin which is generally used in other shoe insoles. This was believed to be likely based on the shape of the support plate 3 of the present invention, but as a result of earnest research focused on this problem, the problem was eliminated by setting the degree of hardness of the support plate 3 to from 40D to 72D.

As shown in FIG. 7, the sheet section 2 and the support plate 3 preferably include respective extension sections 20 and 20' that protrude upward so as to oppose, from a side surface, the heel sections 7, 7' located directly below the lateral malleolus 61 shown in FIG. 3 and/or the base end section of the arch sections 6, 6'. In this case, the extension section 20 and 20' should be approximately parallel in both the sheet section 2 and the support plate 3, i.e. the peripheral edge of the sheet section 2 and the peripheral edge of the support plate 3 are approximately parallel in the extension section 20 and 20'.

Due to the above configuration, an effect is achieved in which supination of the foot (in other words, a movement in which the foot rolls around the little toe side) can be prevented.

As shown in FIGS. 2 and 7, the sheet section 2 may include two foamed resin layers having different degrees of hardness and impact resilience coefficients. A first layer 2*a* on an upper surface side and a second layer 2*b* provided below the first layer 2*a* preferably constitute impact resilient resin layers comprising, as a main component, an ethylene-vinyl acetate copolymer.

Further, the measured degrees of hardness as measured using an Asker rubber durometer (C-type) and the impact resilience coefficients as measured according to ISO4662: 2009 of the first layer 2*a* and the second layer 2*b* preferably satisfy the following relationships.

Measured Degree of Hardness: the first layer 2*a*<the second layer 2*b*, and Impact Resilience Coefficient: the first layer 2*a*<the second layer 2*b*

Specifically, as the first layer 2*a*, a resin comprising EVA as a main component is used, and in order to adjust the impact resilience coefficient, the first layer 2*a* can be configured as a resin layer into which impact absorbing materials such as polyethylene, polypropylene, and a silicon resin are mixed.

More specifically, a resin having a degree of hardness as measured using an Asker rubber durometer (C-type) of 23 to 28, and an impact resilience coefficient as measured according to ISO4662:2009 of 47% to 53%, more preferably 49% to 52%, can be suitably used.

In addition, the first layer 2*a* may be a polyurethane foamed resin layer.

As the second layer 2*b*, specifically, a resin comprising EVA as a main component is used, and in order to adjust the impact resilience coefficient, a resin obtained by compressing a foamed resin comprising EVA as a main component can be used. More specifically, the degree of hardness as measured using an Asker rubber durometer (C-type) should be 50 to 60, and the impact resilience coefficient as measured according to ISO4662:2009 should be 55% to 65%. Further, the degree of hardness as measured using an Asker rubber durometer (C-type) is preferably 53 to 60, and the impact resilience coefficient as measured according to ISO4662:2009 is preferably 57% to 59%.

The first layer 2*a* and the second layer 2*b* are pressed, and then a sheet layer made of fiber is provided on the top surface of the first layer 2*a*. In this state, although not limited thereto, the first layer 2*a* is formed with a thickness of from 0.5 mm to 4.0 mm. Further, although not limited thereto, the second layer 2*b* is formed with a thickness of from 1.0 mm to 4.0 mm. The second layer 2*b* may be formed to be thicker at the heel than at the toe, and if the first layer 2*a* is a polyurethane layer, the first layer 2*a* and the second layer 2*b* may both formed to be thicker than in the case that the first layer 2*a* and the second layer 2*b* comprise EVA as a main component.

Due to the above configuration, the second layer 2*b* is imparted with an appropriate degree of hardness and resilience, and thereby it exerts a cushioning property on the foot. In addition, the first layer 2*a* is imparted with a low degree of hardness, i.e. flexibility, and low resilience, and thereby the first layer 2*a* can be firmly retained following the shape of the sole of the foot, and the foot can be softly supported. Accordingly, an effect is achieved in which the skeletal structure of the foot can be held as correctly as possible, and the foot can be effectively protected from impacts thereto.

EXAMPLES

In the following, the present invention shall be explained in detail using examples, but the scope of the present invention should not be construed as limited to these examples.

Example 1

A shoe insole as indicated in the above embodiments was produced, comprising the sheet section 2 made of a soft synthetic resin such as ethylene-vinyl acetate copolymer (EVA) and having a degree of hardness as measured using an Asker rubber durometer (C-type) of about 55, and the support plate 3 made of a hard resin such as a thermoplastic polyurethane (TPU) and having a degree of hardness of 40D as measured using an Asker rubber durometer (D-type).

Example 2

A shoe insole identical to that of Example 1 was produced, except that the degree of hardness of the support plate 3 was 55D as measured using an Asker rubber durometer (D-type).

Example 3

A shoe insole identical to that of Example 1 was produced, except that the degree of hardness of the support plate 3 was 63.5D as measured using an Asker rubber durometer (D-type).

COMPARATIVE EXAMPLE

A shoe insole identical to that of Example 1 was produced, except that the degree of hardness of the support plate 3 was 72D (comparative example) as measured using an Asker rubber durometer (D-type).

(Evaluation Method)

An adult male A having a height of about 172 cm and a body weight of 75 kg, an adult male B having a height of about 162 cm and a body weight of 53 kg, an adult female C having a height of about 160 cm and a body weight of 52 kg, and an adult female D having a height of about 164 cm and a body weight of 56 kg were made to wear exercise shoes in which the shoe insoles of Examples 1 to 3 and the shoe insole of the comparative example were disposed. The feeling of use was evaluated upon walking on asphalt for about 2 hours. The feeling of use was evaluated regarding (1) the presence/absence of a feeling of support or an uncomfortable feeling in the sole of the foot, (2) the presence/absence of the occurrence of pain in the sole of the foot, and (3) the presence/absence of the occurrence of pain anywhere besides the sole of the foot when walking for no more than 2 hours. In these examples, a "feeling of support" indicates whether there is a sensation that the sole of the foot is being held (retained) by the insole, and an "uncomfortable feeling" indicates localized or overall discomfort. The evaluation results are shown below in Tables 1 to 4.

TABLE 1

| EXAMPLE 1 | Male A | Male B | Female C | Female D |
|---|---|---|---|---|
| (1) Presence/absence of feeling of support or uncomfortable feeling in sole | No uncomfortable feeling. Feeling of support slightly weak. | No uncomfortable feeling. | No uncomfortable feeling. Feeling of support felt somewhat weak in heel and arch of foot. | No uncomfortable feeling. Feeling of support slightly weak. |
| (2) Presence/absence of pain in sole | Slight fatigue in overall sole of foot. | None in particular. | Slight feeling of pain in root of middle toe and fourth toe on one foot. | None in particular. |
| (3) Presence/absence of pain anywhere besides sole | None in particular. | Felt fatigue in thigh and calf. | None in particular. | None in particular. |

TABLE 2

| EXAMPLE 2 | Male A | Male B | Female C | Female D |
|---|---|---|---|---|
| (1) Presence/absence of feeling of support or uncomfortable feeling in sole | Felt appropriate amount of support. No uncomfortable feeling. | Felt appropriate amount of support. No uncomfortable feeling. | Felt appropriate amount of support. No uncomfortable feeling. | Felt appropriate amount of support. No uncomfortable feeling. |
| (2) Presence/absence of pain in sole | Experienced no fatigue at about 2 hours. | Experienced no fatigue at about 2 hours. | Experienced no fatigue at about 2 hours. | Experienced no fatigue at about 2 hours. |
| (3) Presence/absence of pain anywhere besides sole | Experienced no fatigue at about 2 hours. | Experienced no fatigue at about 2 hours. | Experienced no fatigue at about 2 hours. | Experienced no fatigue at about 2 hours. |

TABLE 3

| EXAMPLE 3 | Male A | Male B | Female C | Female D |
|---|---|---|---|---|
| (1) Presence/absence of feeling of support or uncomfortable feeling in sole | Felt slightly uncomfortable in heel and forward inner side. | No uncomfortable feeling in particular. | Felt like heel was being held immediately upon wearing shoe, and felt a close fit over entire sole. | Felt slightly uncomfortable in arch of foot. |
| (2) Presence/absence of pain in sole | Was able to use without any problems for around 2 hours, but started to feel slight pain once a long period (over 2 hours) had elapsed. | Felt pain due to chafing at edge portion of heel cup. | None in particular. | Experienced a very slight sensation of pain and uncomfortable feeling. |
| (3) Presence/absence of pain anywhere besides sole | Experienced no fatigue at about 2 hours. | None in particular. | None in particular. | None in particular. |

TABLE 4

| COMP. EX. | Male A | Male B | Female C | Female D |
|---|---|---|---|---|
| (1) Presence/absence of feeling of support or uncomfortable feeling in sole | Felt uncomfortable on front inner side of heel bone. | Felt uncomfortable in sustentaculum tali. Felt pressure on sole of foot. | Experienced a feeling of a foreign object being present at location near space between arch of foot and heel. | Felt uncomfortable immediately upon wearing shoe. Arch felt stiff. |
| (2) Presence/absence of pain in sole | Felt uncomfortable at front inner side of heel bone at about 1 hour of use. Felt pain at same location soon after. | Upon walking, felt pain due to chafing at edge portion of heel cup. | Felt pain after about 15 minutes, and this pain continued for about 25 minutes thereafter. | Felt slight numbness after about 10 minutes. Felt pain after about 30 minutes, and could not walk naturally. |
| (3) Presence/absence of pain anywhere besides sole | Experienced no fatigue at about 2 hours. | Experienced no fatigue at about 2 hours. | None in particular. | None in particular. |

In the evaluation results shown in Tables 1 to 4, the shoe insole in which the support plate 3 had a degree of hardness of 40D did not cause an uncomfortable feeling, but the feeling of support was slightly weak.

The shoe insole in which the support plate 3 had a degree of hardness of 55D exhibited a good feeling of support without any uncomfortable feelings, and did not readily cause pain in the sole of the foot. Further, since this shoe insole also did not readily cause pain in other areas besides the sole of the foot, it can be surmised that the shape of the sole of the foot was satisfactorily retained.

The shoe insole in which the support plate 3 had a degree of hardness of 63.5D provided a feeling of support, but also caused slightly uncomfortable feelings, and caused pain in the sole of the foot after a prolonged period of use.

The shoe insole in which the support plate 3 had a degree of hardness of 72D was prone to cause uncomfortable feelings, and caused pain in the sole of the foot even after use over a short period.

REFERENCE SIGNS LIST

1: shoe insole
2: sheet section
3: support plate
4: toe section
5: bulged section

6: arch section
7: heel section
8: inner wall section
9: outer wall section
10: central wall section of the sheet section
10': central wall section of the support plate
10*a*: central front wall section of the sheet section
10*a*': central front wall section of the support plate
10*b*: central rear wall section of the sheet section
10*b*': central rear wall section of the support plate
13: thick section (portion of sheet section)
14: central convex section
15: inner ridge section
16: outer ridge section
18: through-hole
19: opening
20: extension section of the sheet section
20': extension sections of the support plate
UP: upper surface of the support plate
BT: bottom surface of the support plate

What is claimed is:

1. A shoe insole comprising:

a sheet section configured to be arrangeable onto an entire base of a shoe, the sheet section being formed of a soft synthetic resin, the sheet section including a toe section formed such that the toes of a foot can be disposed therein, a bulged section formed such that tips of metatarsal bones at which the width of the foot protrudes farthest to the left and right can be disposed therein, an arch section formed such that a section of the foot from the metatarsal bones to directly below the lateral malleolus can be disposed therein, and a heel section formed such that a section of the foot from directly below the lateral malleolus to the heel bone rearward of the lateral malleolus can be disposed therein; and a support plate that is adhered to a bottom surface of the arch section and the heel section of the sheet section, and that is formed from a material which is formed of a hard resin, wherein the sheet section comprises in the arch section: an inner wall section curved in an arch shape in a longitudinal direction with an end section standing upward smoothly such that at least a first metatarsal bone can be disposed therein; an outer wall section curved in an arch shape in the longitudinal direction with an end section standing upward smoothly such that at least a fifth metatarsal bone can be disposed therein; a central wall section formed between the inner wall section and the outer wall section, wherein the support plate comprises in a support plate arch section: a support plate inner wall section, which corresponds to the inner wall section of the sheet section, curved in an arch shape in the longitudinal direction with an end section standing upward smoothly such that at least the first metatarsal bone can be disposed therein; a support plate outer wall section, which corresponds to the outer wall section of the sheet section, curved in an arch shape in the longitudinal direction with an end section standing upward smoothly such that at least the fifth metatarsal bone can be disposed therein; a support plate central wall section, which corresponds to the central wall section of the sheet section, formed between the support plate inner wall section and the support plate outer wall section, the support plate comprising an inner ridge formed on a boundary between the support plate inner wall section and the support plate central wall section, and an outer ridge formed on a boundary between the support plate outer wall section and the central wall section, wherein the inner ridge, which protrudes from the bottom surface of a central rear wall section, is formed as a solid band shape within the support plate arch section and is curved in an arch shape in the longitudinal direction, wherein the outer ridge, which protrudes from the bottom surface of the central rear wall section, is formed as a solid band shape within the support plate arch section and is curved in an arch shape in the longitudinal direction, an entirety of the inner ridge is entirely spaced apart from an entirety of the outer ridge such that the inner ridge and the outer ridge are not directly connected to each other, a plurality of through-holes, spaced apart and arranged along the longitudinal direction, are formed in both the inner wall section and the outer wall section of the support plate, where protrusions formed on a bottom surface side of the inner wall section and the outer wall section of the sheet section can fit therein without any gaps, an upper surface and the bottom surface of a central rear wall section of the support plate located between the inner ridge and the outer ridge is curved so as to draw an arch in the longitudinal direction, and the upper surface and the bottom surface of the central rear wall section of the support plate form a longitudinal direction arch shape substantially conforming to the inner ridge and the outer ridge.

2. The shoe insole according to claim 1, wherein the support plate is formed with a degree of hardness of from 40D to less than 72D, and is arranged along a bottom surface shape of the sheet section, wherein the support plate has a fixed thickness.

3. The shoe insole according to claim 1, wherein the support plate is formed with a degree of hardness of from 40D to less than 65D, and is arranged along a bottom surface shape of the sheet section, wherein the support plate has a fixed thickness.

4. The shoe insole according to claim 1, wherein the support plate comprises a support plate heel section, and wherein in the support plate heel section, an opening into which a portion of the sheet section is fitted is formed.

5. The shoe insole according to claim 1, wherein the sheet section comprises at least two foamed resin layers having different impact resilience coefficients, wherein a first layer on an upper surface side constitutes a polyurethane foamed resin layer, wherein a second layer provided below the first layer constitutes an impact resilient resin layer comprising, as a main component, an ethylene-vinyl acetate copolymer, and wherein the measured degree of hardness as measured using an Asker rubber durometer C-type of the second layer is 50 to 60, and the impact resilience coefficient as measured according to ISO4662:2009 of the second layer is 55% to 65%.

6. A shoe insole comprising:

a sheet section configured to be arrangeable onto an entire base of a shoe, the sheet section being formed of a soft synthetic resin, the sheet section including a toe section formed such that the toes of a foot can be disposed therein, a bulged section formed such that tips of metatarsal bones at which the width of the foot protrudes farthest to the left and right can be disposed therein, an arch section formed such that a section of the foot from the metatarsal bones to directly below the lateral malleolus can be disposed therein, and a heel section formed such that a section of the foot from directly below the lateral malleolus to the heel bone rearward of the lateral malleolus can be disposed therein; and a support plate that is adhered to a bottom surface of the arch section and the heel section of the sheet section, and that is formed from a material which is formed of a hard resin, wherein the sheet section comprises in the arch section: an inner wall section curved in an arch shape in a longitudinal direction with an end section standing upward smoothly such that at least a first metatarsal bone can be disposed therein; an outer wall section curved in an arch shape in the longitudinal direction with an end section standing upward smoothly such that at least a fifth metatarsal bone can be disposed therein; a central wall section formed between the inner wall section and the outer wall section, wherein the support plate comprises in a support plate arch section: a support plate inner wall section, which corresponds to the inner wall section of the sheet section, curved in an arch shape in the longitudinal direction with an end section standing upward smoothly such that at least the first metatarsal bone can be disposed therein; a support plate outer wall section, which corresponds to the outer wall section of the sheet section, curved in an arch shape in the longitudinal direction with an end section standing upward smoothly such that at least the fifth metatarsal bone can be disposed therein; a support plate central wall section, which corresponds to the central wall section of the sheet section, formed between the support plate inner wall section and the support plate outer wall section, the support plate comprising an inner ridge formed on a boundary between the support plate inner wall section and the support plate central wall section, and an outer ridge formed on a boundary between the support plate outer wall section and the central wall section, wherein the inner ridge, which protrudes from the bottom surface of a central rear wall section, is formed as a solid band shape within the support plate arch section and is curved in an arch shape in the longitudinal direction, wherein the outer ridge, which protrudes from the bottom surface of the central rear wall section, is formed as a solid band shape within the support plate arch section and is curved in an arch shape in the longitudinal direction, an entirety of the inner ridge is entirely spaced apart from an entirety of the outer ridge such that the inner ridge and the outer ridge are not directly connected to each other, a plurality of through-holes, spaced apart and arranged along the longitudinal direction, are formed in both the inner wall section and the outer wall section of the support plate, where protrusions formed on the bottom surface side of the inner wall section and the outer wall section of the sheet section can fit therein without any gaps, an upper surface and a bottom surface of the support plate central wall section located between the inner ridge and the outer ridge is curved so as to draw an arch in the longitudinal direction, the sheet section comprises an extension section that protrudes upward so as configured to oppose, from a side surface, the heel section configured to be located directly below the lateral malleolus and/or the arch section, and the support plate comprises a support plate extension section that protrudes upward so as configured to oppose, from a side surface, the heel section configured to be located directly below the lateral malleolus and/or the arch section.

7. The shoe insole according to claim 6, wherein the sheet section comprises at least two foamed resin layers having different degrees of hardness and impact resilience coefficients, wherein a first layer on an upper surface side and a second layer provided below the first layer constitute impact resilient resin layers comprising, as a main component, an ethylene-vinyl acetate copolymer, wherein a measured degree of hardness as measured using an Asker rubber durometer C-type and an impact resilience coefficient as measured according to ISO 4662:2009 of the first layer and the second layer satisfy the following relationships:

Measured Degree of Hardness: the first layer<the second layer

Impact Resilience Coefficient: the first layer<the second layer.

8. The shoe insole according to claim 7, wherein the measured degree of hardness as measured using an Asker rubber durometer C-type of the second layer is 50 to 60, and the impact resilience coefficient as measured according to ISO4662:2009 of the second layer is 55% to 65%.

9. The shoe insole according to claim 7, wherein the measured degree of hardness as measured using an Asker rubber durometer C-type of the first layer is 23 to 28, and the impact resilience coefficient as measured according to ISO4662:2009 of the first layer is 47% to 53%.

10. The shoe insole according to claim 6, wherein the support plate is formed with a degree of hardness of from 40D to less than 72D, and is arranged along a bottom surface shape of the sheet section, wherein the support plate has a fixed thickness.

11. The shoe insole according to claim 6, wherein the support plate is formed with a degree of hardness of from 40D to less than 65D, and is arranged along a bottom surface shape of the sheet section, wherein the support plate has a fixed thickness.

12. The shoe insole according to claim 6, wherein the support plate comprises a support plate heel section, and wherein in the support plate heel section, an opening into which a portion of the sheet section is fitted is formed.

13. The shoe insole according to claim 6, wherein the measured degree of hardness as measured using an Asker rubber durometer C-type of a second layer is 50 to 60, and the impact resilience coefficient as measured according to ISO4662:2009 of the second layer is 55% to 65%.

14. The shoe insole according to claim 6, wherein the sheet section comprises at least two foamed resin layers having different impact resilience coefficients, wherein a first layer on an upper surface side constitutes a polyurethane foamed resin layer, wherein a second layer provided below the first layer constitutes an impact resilient resin layer comprising, as a main component, an ethylene-vinyl acetate copolymer, and wherein the measured degree of hardness as measured using an Asker rubber durometer C-type of the second layer is 50 to 60, and the impact resilience coefficient as measured according to ISO4662:2009 of the second layer is 55% to 65%.

15. A shoe insole comprising:

a sheet section configured to be arrangeable onto an entire base of a shoe, the sheet section being formed of a soft synthetic resin, the sheet section including a toe section formed such that the toes of a foot can be disposed therein, a bulged section formed such that tips of metatarsal bones at which the width of the foot protrudes farthest to the left and right can be disposed therein, an arch section formed such that a section of the foot from the metatarsal bones to directly below the lateral malleolus can be disposed therein, and a heel section formed such that a section of the foot from directly below the lateral malleolus to the heel bone rearward of the lateral malleolus can be disposed therein; and a support plate that is adhered to a bottom surface of the arch section and the heel section of the sheet section, and that is formed from a material which is formed of a hard resin, wherein the sheet section comprises in the arch section: an inner wall section curved in an arch shape in a longitudinal direction with an end section standing upward smoothly such that at least a first metatarsal bone can be disposed therein; an outer wall section curved in an arch shape in the longitudinal direction with an end section standing upward smoothly such that at least a fifth metatarsal bone can be disposed therein; a central wall section formed between the inner wall section and the outer wall section, wherein the support plate comprises in a support plate arch section: a support plate inner wall section, which corresponds to the inner wall section of the sheet section, curved in an arch shape in the longitudinal direction with an end section standing upward smoothly such that at least the first metatarsal bone can be disposed therein; a support plate outer wall section, which corresponds to the outer wall section of the sheet section, curved in an arch shape in the longitudinal direction with an end section standing upward smoothly such that at least the fifth metatarsal bone can be disposed therein; a support plate central wall section, which corresponds to the central wall section of the sheet section, formed between the support plate inner wall section and the support plate outer wall section, the support plate comprising an inner ridge formed on a boundary between the support plate inner wall section and the support plate central wall section, and an outer ridge formed on a boundary between the support plate outer wall section and the central wall section, wherein the inner ridge, which protrudes from the bottom surface of a central rear wall section, is formed as a solid band shape within the support plate arch section and is curved in an arch shape in the longitudinal direction, wherein the outer ridge, which protrudes from the bottom surface of the central rear wall section, is formed as a solid band shape within the support plate arch section and is curved in an arch shape in the longitudinal direction, an entirety of the inner ridge is entirely spaced apart from an entirety of the outer ridge such that the inner ridge and the outer ridge are not directly connected to each other, a plurality of through-holes, spaced apart and arranged along the longitudinal direction, are formed in both the inner wall section and the outer wall section of the support plate, where protrusions formed on the bottom surface side of the inner wall section and the outer wall section of the sheet section can fit therein without any gaps, an upper surface and a bottom surface of the central wall section located between the inner ridge and the outer ridge is curved so as to draw an arch in the longitudinal direction, the sheet section comprises at least two foamed resin layers having different degrees of hardness and impact resilience coefficients, wherein a first layer on an upper surface side and a second layer provided below the first layer constitute impact resilient resin layers comprising, as a main component, an ethylene-vinyl acetate copolymer, wherein a measured degree of hardness as measured using an Asker rubber durometer C-type and an impact resilience coefficient as measured according to ISO 4662:2009 of the first layer and the second layer satisfy the following relationships:

Measured Degree of Hardness: the first layer<the second layer

Impact Resilience Coefficient: the first layer<the second layer.

16. The shoe insole according to claim 15, wherein the support plate is formed with a degree of hardness of from 40D to less than 72D, and is arranged along a bottom surface shape of the sheet section, wherein the support plate has a fixed thickness.

17. The shoe insole according to claim 15, wherein the support plate is formed with a degree of hardness of from 40D to less than 65D, and is arranged along a bottom surface shape of the sheet section, wherein the support plate has a fixed thickness.

18. The shoe insole according to claim 15, wherein the support plate comprises a support plate heel section, and wherein in the support plate heel section, an opening into which a portion of the sheet section is fitted is formed.

19. The shoe insole according to claim 15, wherein the measured degree of hardness as measured using an Asker rubber durometer C-type of the second layer is 50 to 60, and the impact resilience coefficient as measured according to ISO4662:2009 of the second layer is 55% to 65%.

20. The shoe insole according to claim 15, wherein the measured degree of hardness as measured using an Asker rubber durometer C-type of the first layer is 23 to 28, and the impact resilience coefficient as measured according to ISO4662:2009 of the first layer is 47% to 53%.

* * * * *